US012016430B2

(12) United States Patent
Siegismund et al.

(10) Patent No.: US 12,016,430 B2
(45) Date of Patent: Jun. 25, 2024

(54) SHOE, ESPECIALLY SPORTS SHOE

(71) Applicant: PUMA SE, Herzogenaurach (DE)

(72) Inventors: Andreas Siegismund, Rückersdorf (DE); Romain Girard, Lauf (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 16/619,764

(22) PCT Filed: Jun. 27, 2017

(86) PCT No.: PCT/EP2017/000750
§ 371 (c)(1),
(2) Date: Dec. 5, 2019

(87) PCT Pub. No.: WO2019/001676
PCT Pub. Date: Jan. 3, 2019

(65) Prior Publication Data
US 2020/0187595 A1 Jun. 18, 2020

(51) Int. Cl.
*A43B 23/02* (2006.01)
*A43C 1/04* (2006.01)

(52) U.S. Cl.
CPC ..... *A43B 23/0245* (2013.01); *A43B 23/0215* (2013.01); *A43C 1/04* (2013.01)

(58) Field of Classification Search
CPC ..... A43B 23/02; A43C 1/04; A43C 5/00
USPC ..... 36/115
See application file for complete search history.

(56) References Cited

U.S. PATENT DOCUMENTS 1,416,203 A * 5/1922 Hobson ..... A43C 5/00 24/713.2
1,538,454 A * 5/1925 Trawinski ..... A43C 5/00 24/714.6
D132,196 S 4/1942 Daniels
D132,197 S 4/1942 Daniels
2,675,631 A * 4/1954 Doughty ..... A43B 1/04 36/9 R (Continued)

FOREIGN PATENT DOCUMENTS

CN 1143310 A 2/1997
CN 101267752 A 9/2008

(Continued)

OTHER PUBLICATIONS

U.S. Appl. No. 62/263,916 provisional application of Guest et al
U.S. Pat. No. 10,492,566 (Year: 2015).*

(Continued)

*Primary Examiner* — Grace Huang
(74) *Attorney, Agent, or Firm* — Quarles & Brady LLP

(57) ABSTRACT

The invention relates to a shoe (1), especially to a sports shoe, comprising a shoe upper (2), wherein the shoe upper (2) consists at least partially of a knitted fabric, wherein the shoe upper (2) has a plurality of loops (3) for threading a lace (4) to allow the tying of the shoe (1) at the foot of a wearer by means of the lace (4). To provide an easy and efficient possibility to adjust the lacing or tying of the shoe at the foot of the wearer individually, the invention is characterized in that at least a part of the loops (3) consist of a knitted fabric, wherein the loops (3) have the shape of a tubular body which forms a passage (8) for the lace (4).

18 Claims, 3 Drawing Sheets

(56) References Cited

U.S. PATENT DOCUMENTS 2,679,117 A * 5/1954 Reed ..... A43B 3/14 36/9 R
4,200,998 A * 5/1980 Adams ..... A43C 1/00 36/50.1
6,240,657 B1 * 6/2001 Weber ..... A43B 1/0072 24/714.8
6,286,233 B1 * 9/2001 Gaither ..... A43C 1/00 36/50.1
6,952,890 B1 * 10/2005 Blakeslee ..... A43C 7/06 24/712.1
7,073,279 B2 * 7/2006 Min ..... A43C 9/04 24/712
D541,516 S 5/2007 Lane, III
7,272,897 B2 * 9/2007 Yu ..... A43B 13/36 36/15
D563,657 S 3/2008 Matis et al.
D574,136 S 8/2008 Avar
7,743,476 B2 * 6/2010 Rock ..... D04B 1/04 28/160
7,774,956 B2 * 8/2010 Dua ..... D04B 1/22 36/50.1
D648,110 S * 11/2011 Rasmussen ..... D2/972
8,161,666 B2 * 4/2012 Liles ..... A43B 23/024 36/99
D667,621 S 9/2012 Portzline
D689,684 S * 9/2013 McMillan ..... D2/972
8,657,773 B2 * 2/2014 Ostergard ..... A43C 5/00 36/89
8,661,711 B2 * 3/2014 Settele ..... A43C 5/00 24/713.2
D718,036 S * 11/2014 McMillan ..... D2/972
8,875,418 B2 * 11/2014 Long ..... A43B 23/0265 36/50.1
8,881,430 B2 * 11/2014 Seamarks ..... A43B 23/07 36/9 R
8,904,671 B2 * 12/2014 Dojan ..... A43B 1/0027 36/47
8,950,088 B2 * 2/2015 Aveni ..... A43B 23/0235 36/54
9,113,674 B2 * 8/2015 Dojan ..... A43B 23/0265
D740,538 S * 10/2015 Roulo ..... D2/972
9,192,204 B1 * 11/2015 Liles ..... A43B 23/0245
D746,558 S * 1/2016 Campbell ..... D2/946
D756,621 S * 5/2016 Weddle ..... D2/969
9,375,046 B2 * 6/2016 Meir ..... D04B 1/123
D768,977 S * 10/2016 Seamarks ..... D2/972
9,498,023 B2 * 11/2016 Craig ..... A43B 1/04
9,510,637 B2 * 12/2016 Podhajny ..... A43B 23/04
9,532,626 B2 * 1/2017 Lovett ..... A43C 7/00
9,700,101 B2 * 7/2017 Lovett ..... A43C 3/02
9,737,117 B2 * 8/2017 Nonogawa ..... A43C 1/006
D814,776 S * 4/2018 Odinot ..... D2/972
D815,413 S * 4/2018 Weddle ..... D2/969
9,936,757 B2 * 4/2018 Podhajny ..... A43B 1/04
10,039,341 B2 * 8/2018 Faucher ..... A43B 7/141
10,051,918 B2 * 8/2018 Dombrow ..... A43B 23/028
D829,425 S * 10/2018 Albrecht ..... D2/969
10,194,714 B2 * 2/2019 McGinnity ..... A43B 23/027
D846,256 S 4/2019 Khalife
10,251,448 B2 * 4/2019 Klug ..... A43B 23/0275
10,316,441 B2 * 6/2019 Ly ..... D04B 1/108
10,327,511 B2 * 6/2019 Boys ..... D04B 1/24
10,492,566 B2 * 12/2019 Guest ..... A43C 11/16
10,499,709 B2 * 12/2019 Pollack ..... A43C 11/004
10,694,817 B2 * 6/2020 McGinnity ..... A43B 1/04
10,702,017 B2 * 7/2020 Taylor ..... A43B 13/223
10,743,618 B2 * 8/2020 Bruce ..... A43B 1/04
10,765,173 B2 * 9/2020 Wilson ..... A43B 23/0245
10,786,035 B2 * 9/2020 Howe ..... A43B 1/04
10,806,210 B2 * 10/2020 Bruce ..... A43B 1/14
10,844,526 B2 * 11/2020 Brinkman ..... A43C 1/04
10,856,619 B2 * 12/2020 Fuerst, Sr. ..... A43B 3/106
10,905,197 B2 * 2/2021 Lee ..... A43B 23/0275
10,918,155 B2 2/2021 Dekovic et al.
D911,678 S 3/2021 Petrie et al.
10,945,482 B2 * 3/2021 Schoppel ..... D04B 1/102
2004/0181972 A1 * 9/2004 Csorba ..... A43C 11/14 36/50.1
2006/0059715 A1 * 3/2006 Aveni ..... A43B 7/08 36/45
2006/0283042 A1 * 12/2006 Greene ..... A43C 1/04 36/3 A
2007/0180730 A1 * 8/2007 Greene ..... A43B 23/0295 36/3 A
2008/0110048 A1 * 5/2008 Dua ..... D04B 1/22 36/45
2009/0056384 A1 * 3/2009 Sayer ..... D04B 1/24 66/64
2010/0154256 A1 6/2010 Dua
2012/0246897 A1 * 10/2012 Lee ..... A43C 1/003 24/713.5
2012/0255201 A1 10/2012 Little
2015/0059209 A1 * 3/2015 Dekovic ..... A43B 1/04 36/84
2015/0289592 A1 * 10/2015 Song ..... A43B 1/04 36/83
2015/0359290 A1 * 12/2015 Podhajny ..... D04B 1/24 36/9 R
2016/0255913 A1 * 9/2016 Uchikawa ..... A43C 5/00
2016/0302524 A1 * 10/2016 Smith ..... A43C 1/04
2016/0302527 A1 * 10/2016 Meir ..... A43B 23/0245
2016/0324269 A1 * 11/2016 Dombrow ..... A43B 7/085
2016/0345675 A1 * 12/2016 Bruce ..... A43B 23/0245
2016/0345677 A1 * 12/2016 Bruce ..... A43B 23/042
2016/0360828 A1 * 12/2016 Guyan ..... B33Y 80/00
2017/0006965 A1 * 1/2017 Musho ..... A43B 23/0295
2017/0035149 A1 * 2/2017 Bruce ..... D04C 3/08
2017/0049187 A1 * 2/2017 Aristizabal ..... D04B 1/108
2017/0071290 A1 * 3/2017 Follet ..... A43B 23/0245
2017/0071291 A1 * 3/2017 Follet ..... A43B 1/04
2018/0035759 A1 * 2/2018 Pollack ..... A43C 11/004
2018/0042333 A1 * 2/2018 Manos-Gully ..... A43B 1/04
2018/0103714 A1 * 4/2018 Howe ..... A43B 7/081
2018/0110294 A1 * 4/2018 Schneider ..... A43C 11/165
2018/0135213 A1 * 5/2018 Bell ..... A43B 1/0009
2018/0255875 A1 * 9/2018 McGinnity ..... A43B 23/0255
2018/0255876 A1 * 9/2018 McGinnity ..... A43B 1/04
2018/0332920 A1 * 11/2018 Burch ..... A43B 13/40
2018/0368506 A1 * 12/2018 Bruce ..... A43B 23/042
2019/0037966 A1 * 2/2019 Aceves Tinajero .. D04B 21/207
2019/0116914 A1 * 4/2019 Schoppel ..... A43B 23/0245
2019/0223541 A1 * 7/2019 Aceves Tinajero .... D04B 1/104
2019/0328075 A1 * 10/2019 Poulsen ..... A43B 23/0265
2020/0022447 A1 * 1/2020 Durrell ..... D04B 1/22
2020/0046078 A1 * 2/2020 Durrell ..... A43B 1/04
2020/0048800 A1 * 2/2020 McFarland, II ..... D04B 1/123
2020/0281302 A1 * 9/2020 Hipp ..... A43B 23/022
2020/0390185 A1 * 12/2020 Howe ..... A43B 23/027
2021/0007443 A1 * 1/2021 Siegismund ..... A43B 23/0215
2021/0052039 A1 * 2/2021 Johnson ..... A43B 13/16
2021/0076776 A1 * 3/2021 Siegismund ..... A43C 1/04
2021/0186156 A1 * 6/2021 Pogl ..... A43B 1/04
2021/0368945 A1 * 12/2021 Bell ..... A43C 11/1493
2021/0378362 A1 * 12/2021 Reis ..... A43C 1/00

FOREIGN PATENT DOCUMENTS

CN 102497792 A 6/2012
CN 103517647 A 1/2014
CN 203633581 U 6/2014
CN 203748765 U 8/2014
CN 205682613 U 11/2016
CN 206182490 U 5/2017
CN 108125314 A * 6/2018
EP 1219195 A1 7/2002
EP 1219196 A1 7/2002
EP 3114951 A1 1/2017
EP 3138431 A1 * 3/2017 ..... A43D 21/00
FR 389990 A * 9/1908 ..... A43C 5/00
FR 471635 A * 11/1914 ..... A43C 5/00

(56) References Cited

FOREIGN PATENT DOCUMENTS

| | | | | | |
|---|---|---|---|---|---|
| GB | 190907001 | A | * | 10/1909 | ..... A43C 5/00 |
| JP | 2005046520 | A | | 2/2005 | |
| WO | WO-2020033794 | A1 | * | 2/2020 | ..... D04B 1/24 |

OTHER PUBLICATIONS

International Search Report and Written Opinion for PCT/EP2017/000750, mailed Mar. 14, 2018.

* cited by examiner

SHOE, ESPECIALLY SPORTS SHOE

CROSS REFERENCE TO RELATED APPLICATIONS

This application is a U.S. National Stage application, filed pursuant to 35 U.S.C. § 371, of international application no. PCT/EP2017/000750, filed on Jun. 27, 2017.

BACKGROUND

The invention relates to a shoe, especially to a sports shoe, comprising a shoe upper, wherein the shoe upper consists at least partially of a knitted fabric, wherein the shoe upper has a plurality of loops for threading a lace to allow the tying of the shoe at the foot of a wearer by means of the lace, wherein the loops are a physical structure that define a plurality of channels, the channels being the negative space defined by the loops, and wherein the term "tunnel" refers to both the physical structure of the loop and the negative space of the channel, and wherein at least a part of the loops consist of a knitted fabric, wherein the loops have the shape of a tubular body which forms a passage for the lace.

Usual lacing devices of shoes, especially of sports shoes, have loops which are arranged at a tying strip which is connected with the shoe upper or is part of the same. The loops are arranged near the tongue of the shoe.

Thus, the ability of the shoe to adapt the lacing or tying to an individual shape of the foot of the wearer is limited. Individual demands can normally not be fulfilled. This can lead to a loose fit of the shoe or to pressure marks at the foot of the wearer.

A shoe of the generic kind is shown in EP 3 114 951 A1. Similar solutions are disclosed in US 2016/0302524 A1 and US 2008/0110048 A1.

SUMMARY

It is an object of the present invention to propose a shoe, especially a sports shoe, which provides an easy and efficient possibility to adjust the lacing or tying of the shoe at the foot of the wearer very individually.

The solution of this object according to the invention is characterized in that the knitted fabric of the shoe upper and the knitted fabric of the loops form a unitary knit construction, wherein the loops are connected with the knitted fabric of the shoe upper only by the knitted construction and are free from any means for transferring a tying force (like for example tensile strands which are arranged on or in the shoe upper).

At least a part of the loops can have an outer diameter and an inner diameter to form the tubular body for receiving the lace, wherein the tubular body has a length, wherein the length is at least 100% of the outer diameter. Preferably, the length is at least 150%, specifically at least 200%, of the outer diameter. Each loop consists of a plurality of knitted rows of yarn.

The tubular body of the loops and channels can have an axial direction, wherein the axial direction is oriented in the longitudinal direction of the shoe or draws an angle to the longitudinal direction below 30°, preferably below 25°. The longitudinal direction of the shoe is defined by a longitudinal plane that is parallel with respect to a resting surface when the shoe is resting on the resting surface. But this orientation of the loops is not mandatory. It is also possible to orient the loops under another angle up to 90° to the longitudinal direction (i.e. perpendicular to the longitudinal direction).

Preferably a number of loops is arranged in such a manner that the loops have the same axial direction.

The loops are preferably distanced from another by a distance, measured perpendicular to the axial direction, wherein the distance is between 2 mm and 25 mm.

The knitted fabric of the shoe upper can form a single layer which bears the loops.

An alternative embodiment provides that the knitted fabric of the shoe upper has at least two layers, wherein the upper layer bears the loops. In this case it can be provided that the layer below the upper layer is connected with the upper layer but has no contact with the loops.

According to a preferred embodiment of the invention the yarn of the shoe upper can consist of or comprise polyester or polyamide. Also, the yarn of the loops can consist of or comprise polyester or polyamide. Of course, also other kinds of yarn are suitable.

The yarns of the shoe upper and of the loops can be different in at least one (physical) property. Specifically, the yarns of the shoe upper and of the loops can have different colors. Of course, it is also possible to use the same yarn for the shoe upper and the loops.

By the proposed concept it is possible to provide a plurality of loops for threading of the lace which can be selected according to individual demands. The loops for the lace are distributed along a quite large area of the shoe upper so that the user can select the required loops according to his or her individual demands. So the lacing or tying of the shoe can be adapted perfectly not only to the shape of the foot of the wearer; it is also possible to take specific demands in consideration which depend on the type of sports and specific training situations.

It is also possible for specific types of sport or training situations to tie the shoe at the foot of the wearer to fix the shoe specifically for lateral or forward movements or to give more hold in the heel region.

Also with respect to this aspect the proposed shoe has advantages compared with pre-known solutions.

Thus, a knitted section of the shoe upper—which is relevant for tying the shoe at the foot of the wearer—is supplied at the outer surface with a plurality of loops or channels (tunnels) which are designed and dimensioned for defining a passage for a lace. The loops are made in such a manner that they are firmly connected with the knitted fabric to avoid pulling out the loops from the knitted fabric below.

A double layer knitted fabric (Double Jersey) is preferred, wherein the loops step out from the upper layer. The bottom layer is flat and ensures the stability of the whole fabric. Also a knitted fabric as a single layer (Single Jersey) is possible which then bears the plurality of loops (tubes, channels or tunnels).

The shoe upper can consist completely of the knitted fabric.

The knitted tubular body which forms the loops can be produced with well-known methods so that a specific description is not necessary here. Reference is made to the so-called Ottoman Stitch which allows the knitting of the loops on a respective knitting machine.

It was found that the knitted base material (made preferably from polyester or polyamide) as well as the number of filaments in the knitting yarn define the tensile strength. Also the length of the loops (channels, tubes) has a respective influence with respect to the stability. Accordingly, it can be taken in consideration to enlarge the length of the loops in the case of types of sports where specific high forces must be expected.

With regard to the knitting technique it should be mentioned that a preferred method is knitting the shoe upper from the right to the left side (i.e. from the lateral side to the medial side of the shoe upper (or vise versa); normally, the shoe upper is knitted from the shoe tip to the heel (or vice versa).

BRIEF DESCRIPTION OF THE DRAWINGS

In the drawings embodiments of the invention are shown.

DETAILED DESCRIPTION OF THE DRAWINGS

Figure 1:
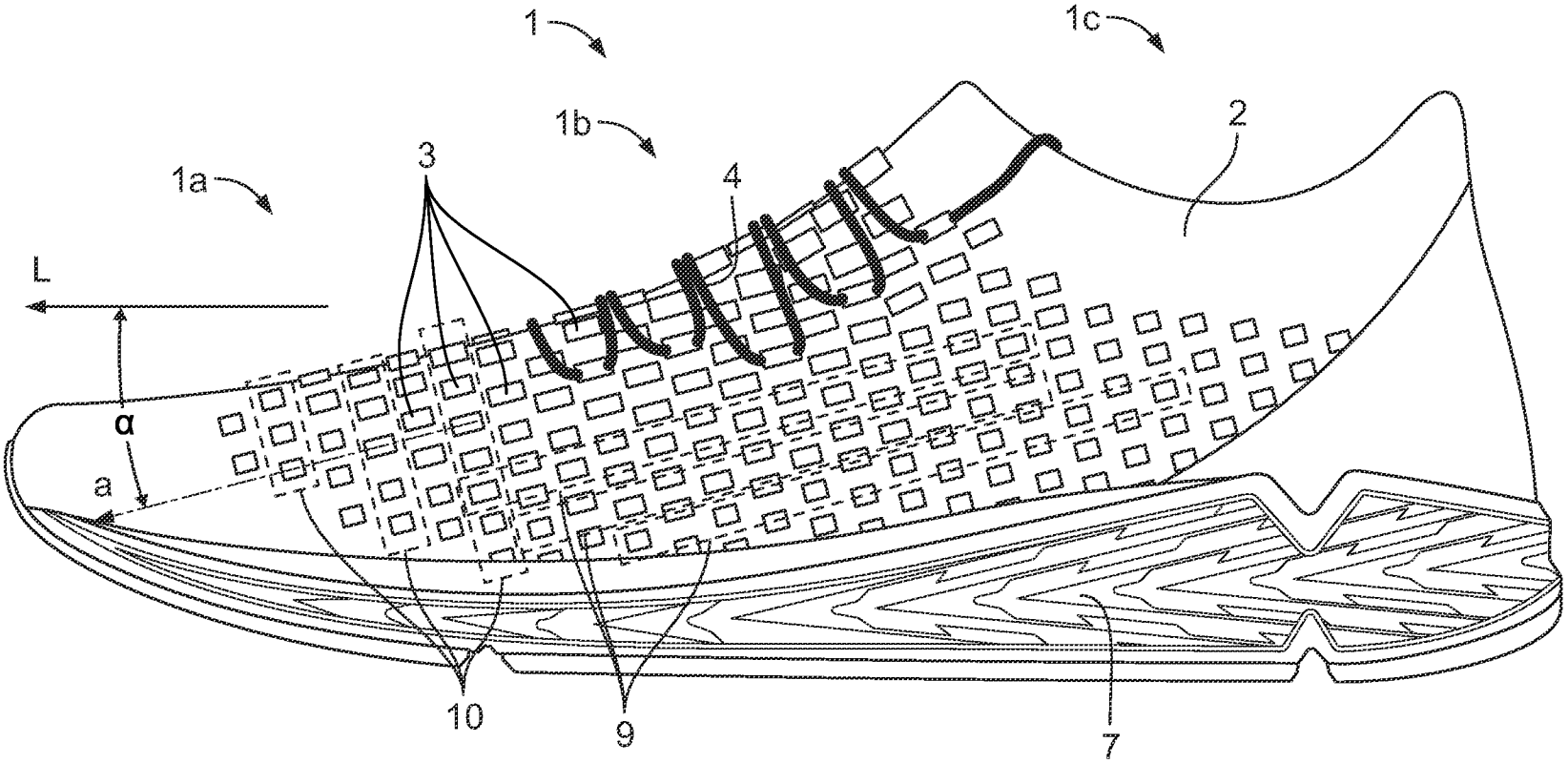
FIG. 1 shows a side view of a sports shoe.

In FIG. 1 a shoe 1 is shown which is a sports shoe. The shoe 1 has a shoe upper 2 and a sole structure 7 which is connected with the shoe upper 2. The shoe 1 has a lateral side, which would be proximate to the outer edge of the foot of a wearer and a medial side, which would be proximate to the inner edge of the foot of a wearer. In the present case the shoe upper 2 consists completely from a knitted fabric. A specific design is provided to allow an individual tying of the shoe at the foot of a wearer.

As can be seen from FIG. 1 a plurality of loops 3 are arranged at and extend from the outer surface defined by a knitted layer of the shoe upper 2. At least some of the plurality of loops are disposed in a plurality of rows 9 and a plurality of columns 10 along the upper. Each of the columns 10 includes a subset of first loops arranged in a column, and each of the rows 9 includes a subset of second loops that are arranged in a row. Intersection loops 12 (see FIGS. 2-5) are shown, which are defined as a single loop within a third subset of loops. FIG. 1 illustrates a plurality of the columns 10 and a plurality of the rows 9. At least some of the plurality of loops 3 can define a first plurality of loops that each define a first channel. Additionally, at least some of the plurality of loops 3 can define a second plurality of loops that each define a second channel. At least part of the loops 3 comprises a knitted fabric and form a unitary knitted construction together with the knitted layer of the shoe upper 2.

Each loop 3 is designed as a tubular body which could also be defined as channel or tunnel and is arranged for threading a lace 4. Thus, each loop 3 forms a passage 8 for the lace 4 (see FIGS. 2 and 4).

As can be also seen from FIG. 1, the shoe 1 includes a forefoot region 1*a*, a midfoot region 1*b*, and a heel region 1*c*. The midfoot region 1*b* is disposed between the forefoot region 1*a* and the heel region 1*c*. Further, the plurality of loops 3 are [is] distributed at the outer side of the shoe upper 2 according to a specific pattern: A number of loops 3, which can define a first channel, a second channel, a third channel, a fourth channel, a fifth channel, a sixth channel, a seventh channel, an eighth channel, a ninth channel, a tenth channel, an eleventh channel, and/or a twelfth channel, is arranged in line along their axial direction a. From FIG. 1 it becomes apparent that loops (channels) arranged in line along their axial direction "a" can define a row. For example, the first channel and the second channel may be coaxial and define a first channel row, the third channel and the fourth channel may be coaxial and define a second channel row, the fifth channel and sixth channels may similarly define a third channel row, and so on. From FIGS. 1-5 it becomes apparent that a channel row may also comprise three or more channels. A number of such sets of loops 3 are arranged on the lateral side of the upper 2 of the shoe 1 with a certain distance perpendicular to the mentioned axial direction "a" (details see FIGS. 2 and 3), and define a subset of first loops of the plurality of loops 3 ("first loops") that are parallel to one another but separated by a distance measured perpendicular to the mentioned axial direction "a", and are thus parallel to one another but not coaxial (i.e. are arranged in the columns 10). From FIGS. 1-5 it becomes apparent that at least two of loops 3, or at least three of loops 3, or more than three of loops 3, can define a set of first loops. The axial direction "a" extends from a heel end toward a toe end of the upper 2.

That is, a plurality of possibilities is given for threading the lace 4 through respective loops 3 so that the shoe 1 can be tied according to individual demands at the foot of the wearer. From FIGS. 1-5 it becomes apparent that a lace can be threaded through at least one of the first, second, third, and fourth channel rows. From FIGS. 1-5 it also becomes apparent that the lace may, or may not, be configured for tying of the shoe at a foot of a wearer.

Figure 2:
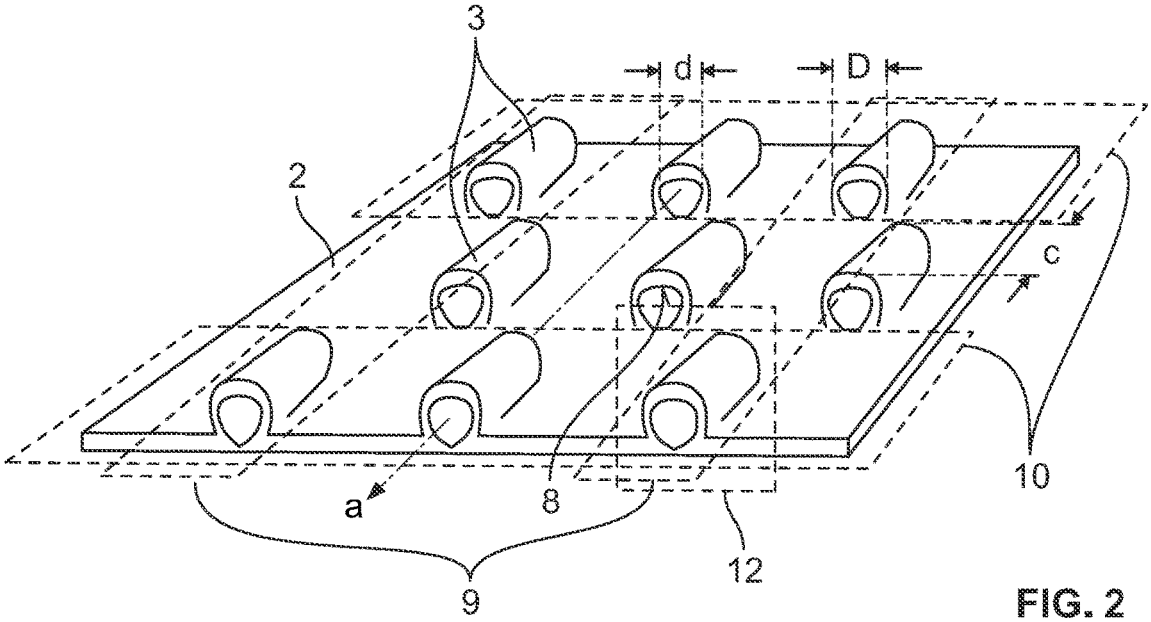
FIG. 2 shows a perspective view of a part of the upper side of a shoe upper according to a first embodiment of the invention.
Figure 3:
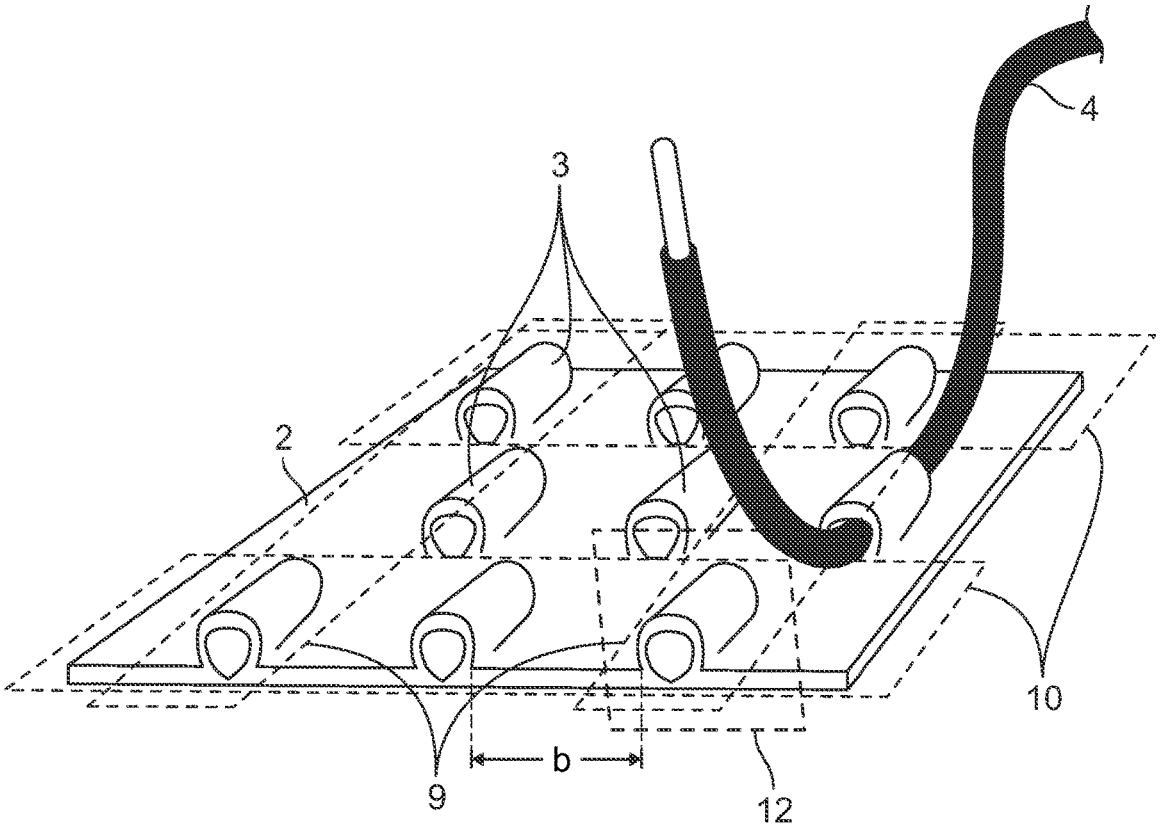
FIG. 3 shows the depiction according to FIG. 2 with a lace being threaded through a loop.

Details concerning the geometry of the loops 3 become apparent from FIGS. 2 and 3. Here, it can be seen that each loop 3 forms a hollow-cylindrical body, i.e. the loop 3 has a tubular shape. Each loop 3 has an outer diameter D and an inner diameter d as well as a length c, which extends in axial direction a of the loop 3.

FIG. 2 illustrates the top surface of the shoe upper 2 without lace 4, while the lace 4 is threaded through a loop 3 in FIG. 3. The knitted fabric of the shoe upper and the knitted fabric of the loops or tubular bodies 3 forms a unitary knit construction. The tubular bodies 3 are connected with the knitted fabric of the shoe upper by the knitted construction, and the plurality of tubular bodies 3 includes a plurality of lateral tubular bodies on a lateral side of the shoe upper and a plurality of medial tubular bodies on a medial side of the shoe upper 2.

From FIG. 2 it becomes apparent that a number of loops 3 can also define a subset of second loops ("second loops") that can be arranged coaxially to one another, i.e. the axial direction a of a number of loops 3, and the axial direction of their respective channels, is identical. Each of the rows 9 of loops comprises a subset of the second loops. From FIGS. 1-5 it becomes apparent that at least two of loops 3, or at least three of loops 3, or more than three of loops 3, can define a subset of second loops. The first plurality of loops are arranged coaxially to form a first row. The second plurality of loops are arranged coaxially to form a second row. A number of those rows 9 of loops 3 can also define a set of "first loops" that is arranged side by side in columns 10, i.e. parallel to one another at a distance b measured perpendicular to the axial direction a, wherein distance b is greater than 0 millimeters. From FIGS. 2-5 it becomes apparent that the first plurality of loops forming the first row and the second plurality of loops forming the second row can be arranged side by side and in parallel with respect to one another. From FIG. 1 it becomes apparent that the first plurality of loops and the second plurality of loops are provided on a lateral side of the upper 2 of shoe 1.

The axial direction a of the loops 3 is substantially oriented in the longitudinal direction L of the shoe 1 (see FIG. 1). That is, the axial direction a draws only a small angle α to the longitudinal direction L which is below 30°, preferably below 25°. This allows an optimal threading of the lace 4 and a good transfer of forces from the loop 3 to the shoe upper 2.

Figure 4:
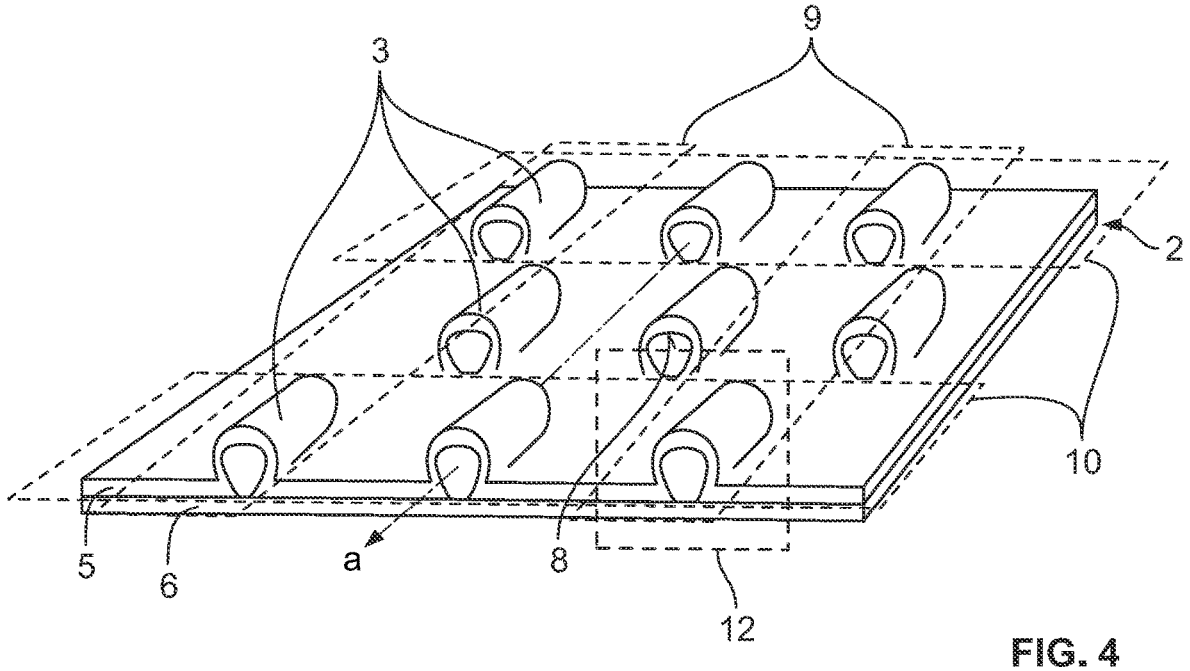
FIG. 4 shows a perspective view of a part of the upper side of a shoe upper according to a second embodiment of the invention and FIG. 5 shows the depiction according to FIG. 4 with a lace being threaded through a loop.
Figure 5:
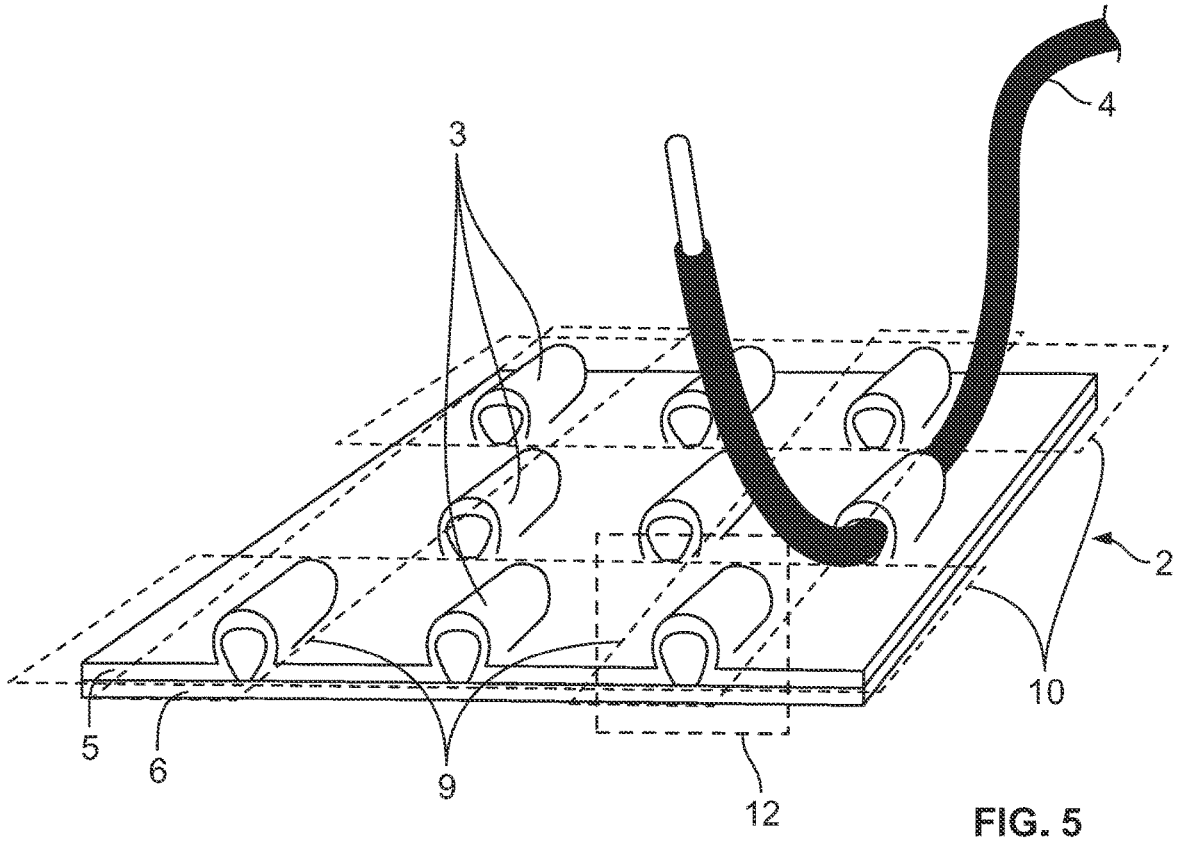

In the embodiment according to FIGS. 2 and 3 the shoe upper 2 has only a single layer of knitted fabric (Single Jersey). In FIGS. 4 and 5 an embodiment is depicted in which the shoe upper 2 consists of two layers 5 and 6, namely of an upper layer 5 of the shoe upper 2 and a bottom layer 6 of the shoe upper 2 (Double Jersey). The loops 3 are formed as a unitary knitted construction with the upper layer 5 while the bottom layer 6 is connected with the upper layer 5 but not with the loops 3.

FIG. 1 shows an embodiment which is substantially on scale with regard to the dimensions of the loops 3. From FIGS. 1-5 it becomes apparent that a number of loops 3 can define another subset of loops, i.e., intersection loops 12 ("third loops") that can be part of the subset of second loops that are arranged coaxially, while also simultaneously being a part of the subset of first loops that are arranged parallel to one another at a distance b. From FIGS. 1-5 it becomes apparent that a plurality of loops 3 can define a subset of third loops.

The whole knitting construction of the shoe upper 2 including the loops 3 can be produced on a knitting machine which is well known as such and allows an economical production of the shoe upper 2.

REFERENCE NUMERALS

1 Shoe
2 Shoe upper
3 Loop
4 Lace
5 Upper layer of the shoe upper
6 Bottom layer of the shoe upper
7 Sole
8 Passage (channel)
9 Row of Loops
10 Column of Loops
11 Tunnel
12 Intersection Loops
D Outer diameter of the loop
d Inner diameter of the loop
c Length of the loop
a Axial direction of the loop
b Distance between the loops
L Longitudinal direction of the shoe
α Angle

The invention claimed is:

1. A shoe having a forefoot region, a heel region, and a midfoot region between the forefoot region and the heel region, the shoe comprising a shoe upper, wherein the shoe upper comprises a knitted fabric, wherein the shoe upper defines an outermost surface and has a first column of tubular bodies, a second column of tubular bodies, and a third column of tubular bodies extending therefrom, wherein each of the tubular bodies is entirely comprised of the knitted fabric such that the knitted fabric of the shoe upper and the knitted fabric of the tubular bodies forms a unitary knit construction, and each of the tubular bodies defines a tubular cavity in a pre-laced configuration, which includes a lower cavity that is disposed entirely below adjacent portions of the outermost surface and an upper cavity that is disposed entirely above adjacent portions of the outermost surface, wherein the first column of tubular bodies and the second column of tubular bodies are entirely disposed within the forefoot region of the shoe, wherein each of the tubular bodies within the first column, the second column, and the third column define an outer diameter (D) and a length (c), wherein the length (c) extends in an axial direction (a), and wherein for each of the tubular bodies within the first column, the second column, and the third column, the length (c) of each tubular body is greater than the outer diameter (D) of each tubular body, and wherein the axial direction (a) extends from the heel region to the forefoot region.

2. The shoe of claim 1, wherein each of the tubular bodies further comprise an inner diameter (d) defining a channel that is configured to receive a lace.

3. The shoe of claim 2, wherein the length (c) is at least 150% of the outer diameter (D).

4. The shoe of claim 2, wherein the length (c) is at least 200% of the outer diameter (D).

5. The shoe of claim 1, wherein a first row of tubular bodies, a second row of tubular bodies, and a third row of tubular bodies are defined by the tubular bodies of the first column of tubular bodies, the second column of tubular bodies, and the third column of tubular bodies, and wherein the first, second, and third rows of tubular bodies are parallel.

6. The shoe of claim 5, wherein a lace extends along at least one of the first, second, and third rows to be received in a tubular body of the first column and a tubular body of the second column.

7. The shoe of claim 1, wherein all of the tubular bodies along the entire upper are arranged in such a manner that the tubular bodies are aligned in the same direction.

8. The shoe of claim 1, wherein an upper layer of the knitted fabric bears the tubular bodies, and wherein a lower layer of the knitted fabric is disposed beneath the upper layer.

9. The shoe of claim 8, wherein the lower layer that is disposed below the upper layer is connected with the upper layer but has no contact with the tubular bodies of the first, second, and third columns of tubular bodies.

10. The shoe of claim 1, wherein a yarn of the shoe upper consists of polyester or polyamide.

11. The shoe of claim 1, wherein a yarn of the shoe upper and a yarn of the first, second, and third columns of tubular bodies are different in at least one property.

12. The shoe of claim 11, wherein the yarn of the shoe upper and the yarn of the first, second, and third columns of tubular bodies have different colors.

13. The shoe of claim 1, wherein all of the tubular bodies are aligned in the same direction.

14. The shoe of claim 1, wherein the first, second, and third columns are all parallel with respect to one another.

15. The shoe of claim 1, wherein the shoe upper further includes a fourth column of tubular bodies that is disposed entirely within the midfoot region of the shoe.

16. The shoe of claim 15, wherein a first row of tubular bodies and a second row of tubular bodies are defined by the tubular bodies of the first, second, third, and fourth columns of tubular bodies, and wherein the first and second rows of tubular bodies are parallel and the tubular bodies of the first and second rows of tubular bodies are aligned in the same direction.

17. The shoe of claim 1, wherein each of the lower cavities of each of the tubular bodies defines a v-shaped profile and each of the upper cavities of each of the tubular bodies defines a rounded profile.

18. The shoe of claim 1, wherein a cross-sectional profile of each of the lower cavities of each of the tubular bodies defines a smaller area than a cross-sectional profile of each of the upper cavities of each of the tubular bodies.

* * * * *